US005193705A

United States Patent [19]

McCallum et al.

[11] Patent Number: 5,193,705

[45] Date of Patent: Mar. 16, 1993

[54] TRANSPORTATION RING

[75] Inventors: Duncan J. McCallum, Hinsdale; John P. Williams, Geneva; Robert C. Jack, Schaumburg, all of Ill.

[73] Assignee: Armstrong Containers, Inc., Westchester, Ill.

[21] Appl. No.: 861,645

[22] Filed: Apr. 1, 1992

[51] Int. Cl.[5] ..... B65D 45/32

[52] U.S. Cl. ..... 220/319; 220/694; 220/354

[58] Field of Search ..... 220/319, 354, 306, 284, 220/285, 380, 694

[56] References Cited

U.S. PATENT DOCUMENTS

| | | | |
|---|---|---|---|
| 1,593,633 | 7/1926 | Johnson | 220/284 |
| 1,847,245 | 3/1932 | Hothersall | 220/284 X |
| 1,948,920 | 2/1934 | Johnson | 220/284 X |
| 3,298,561 | 1/1967 | McConnie . | |
| 3,815,777 | 6/1974 | Churan | 220/319 |
| 3,913,785 | 10/1975 | Pattershall . | |
| 4,111,330 | 9/1978 | Jordan | 220/306 |
| 4,165,018 | 8/1979 | Giggard | 220/284 |
| 4,595,111 | 6/1986 | Gould et al. | 220/285 X |
| 4,625,890 | 12/1986 | Galer | 220/319 |
| 4,728,003 | 3/1988 | Davey | 220/319 |
| 4,932,554 | 6/1990 | Smith et al. | 220/319 |
| 4,969,570 | 10/1990 | Harvey et al. . | |

FOREIGN PATENT DOCUMENTS 552834 2/1958 Canada .

*Primary Examiner*—Allan N. Shoap
*Assistant Examiner*—Paul A. Schwarz
*Attorney, Agent, or Firm*—McCaleb, Lucas & Brugman

[57] ABSTRACT

A unitary, removable, transportation ring for retaining the lid or cover on a cylindrical container, such as a metal paint can, which operatively fits over the outer margin of the container's friction-fit cover and upper rim flange; such ring being molded of rigid plastic material to form a unitary annular member of generally inverted U-shape cross section defining an annular body having a raised planar platform forming a stacking ring on the upper side of its body and two parallel annular limbs depending from the underside of the body; the radially outer annular limb having a continuous radially inwardly projecting locking bead or finger adapted to underengage the upper rim flange of the container whereby to secure and retain the transportation ring in operating position while the inner annular limb is relatively longer and thinner than the outer limb and is designed to depend freely into an underlying annular recess formed near the outer edge of the container's lid or cover to frictionally fit into a corresponding annular channel formed in the container's upper rim flange whereby to frictionally lock the lid or cover in place over the open upper end of the container; the transportation ring hereof effectively retaining the lid on the container to prevent leakage in the presence of abnormal hydrostatic pressures within the container.

7 Claims, 2 Drawing Sheets

TRANSPORTATION RING

This invention relates generally to transportation rings for cylindrical containers, particularly liquid carrying containers such as paint cans and the like and more specifically concerns an improved ring attachment for the upper end of such containers to promote safe transportation of dangerous liquids therein.

BACKGROUND OF THE INVENTION

In the transportation, of so called dangerous goods, such as liquid chemicals, paints and toxic liquids, it is imperative that measures be adopted to reasonably guarantee the sealed integrity of the liquid carrying containers and more especially the sealing covers or lids for such containers which are typically cylindrical, as in the case of paint cans, for example. Such measures must include protection against the presence of abnormal hydrostatic pressures within a container as may occur from impact, extreme pressure differentials or indentation of the container's walls or by liquid vaporization in order that the sealed integrity thereof be maintained and leakage of liquid contents be avoided.

Recently the United Nations Committee on the transportation of dangerous goods adopted certain regulations which provide a common and uniform measuring system for specifying packaging and container requirements to be applied internationally. In general such requirements differ from existing U.S. governmental regulations in that are directed to the performance of the package rather than to the type of materials involved therein. Among such United Nations regulations are new performance tests having to do with internal pressures of the containers, which in the present case concern generally cylindrical metal paint cans having removable friction locked lids or covers. In brief, this test requires a container with lid or cover in place to be filled with water and subjected to predetermined internal pressures for a specific duration. No leakage may occur during the time period in order for the container to pass the test. Based on the vapor pressure of the product being packaged, the internal testing pressure is broken down into three groupings, which in the case of a multi-friction fit paint container or its equivalent, requires the sealed container to withstand an internal pressure of 14.5 psi (100 KPa) for a period of five minutes.

Since such a multi-friction fit container is not engineered to be a pressure vessel, without some modification it will not normally comply with the United Nations test regulations.

SUMMARY OF THE INVENTION

In order to solve the aforenoted problem of packaging in compliance with the United Nations regulations, and promote the safety of transporting liquids, particularly dangerous liquids, including paint, in vessels or containers having friction-fit locking lids or covers as in the familiar one gallon paint pail or can, an improved transportation ring in accordance with this invention was developed. In this respect it is important to note that just maintaining or keeping the cover on the container is not adequate, leakage must be avoided. If it were adequate, the use of metal can clips, such as those disclosed in the Canadian Letters Patent No. 552834, issued Feb. 4, 1958, entitled Fastening Device, could be used. However, that is not the case since experience has shown that even using a large number of such metal clips does not prevent leakage under the requisite United Nation test requirements.

In brief, the present invention satisfies such requirements by providing a generally rigid unitary transportation ring for use with metal friction-fit covered paint cans or containers which enables such containers to withstand abnormal internal pressures of at least 14.5 psi for a period of five (5) minutes without leaking. Such increased internal pressures may be brought about by increased volatility of the contained liquid or by a sudden impact, extreme pressure differentials or indenting of the container or by various load pressures and forces transmitted to the container during active transportation, particularly over long distances. To that end the transportation ring of this invention comprises a unitary plastic ring of annular configuration having a generally planar annular main body equipped with a raised platform on the upper face thereof for the purpose of stacking containers coaxially, one on top of the other.

The ring of this invention is further distinguished by a pair of depending annular limbs extending from the bottom side of the body thereof, one adjacent the outer radial margin thereof termed hereinafter the "outer limb" and a second "inner limb" depending from the inner radial margin of the body. Both such limbs project at right angles to the plane of the body. The outer annular limb is further configured with a radially inwardly extending or projecting annular locking finger which is constructed and arranged to underengage the rim flange of the container to secure the ring in operating position surrounding the rim flange of the container and partially overlying such flange and the outer radial margins of the can cover or lid. The second or inner annular limb is constructed of a longer length or axial extent than the outer annular limb and has a thinner radial wall thickness which dictates its free entry and passage into an underdisposed annular recess portion formed adjacent the outer margin of the container's lid; such recess portion being adapted, when the lid is mounted over the container, to enter and frictionally engage the walls of a corresponding channel or groove formed in the container's upper rim flange whereby to effect a friction fit lock or seal between the lid and the container. The lid or cover, of course, closes the open mouth of the container and its frictional interlock with the rim flange of the container serves to seal liquid contents therein. Importantly the limbs and the locking finger of the locking ring of this invention are continuous or uninterrupted throughout their annular extent so that the interlocking relationship between the transportation ring and the upper end of the container, particularly the upper rim flange thereof, is continuous about the circumference of the container. This feature insures improved sealability, particularly under internal pressure conditions, by virtue of the locking engagement of the annular locking finger with the underside of the container's upper rim flange and the normal frictional sealing condition between the underface of the transportation ring body and the outside rim of the container's cover or lid. Additionally, in the presence of extreme or abnormal pressure conditions within the container or impact sufficient to upwardly bulge or bow the cover, unique and novel pivoting or axial distortion activity of the transportation ring takes place about the ring's locking finger. This activity effectively forces the inner elongated limb of the transportation ring to move radially inwardly into sealing interference with and against an adjacent wall of the cover recess into which the inner limb normally freely depends. This action forces the wall of the cover recess tightly against an adjacent wall of the channel in the container's upper rim flange to effectively increase sealing engagement between the inner limb and cover as pressure within the container increases.

It is a principle object of this invention to provide an improved transportation safety ring for use with liquid carrying containers having friction fit covers.

Another important object of this invention is to provide improved means in the form of a removable unitary transportation ring for use with containers carrying dangerous liquids and having friction fit covers, such as paint cans, which is actively operable in the presence of predetermined abnormal pressures within the container to maintain the friction-fit lid or cover tightly sealed over the open end of the container.

Still another important object of this invention is to provide a removable transportation ring for use on a liquid carrying vessel or container having a friction fit cover which is productive of improved resistance to forces tending to remove or loosen the cover and ring.

Still another further and important object of this invention is to provide an improved unitary transportation ring for use with metal containers of generally cylindrical configuration sealed by a friction fit cover over one end thereof for containing toxic liquids, such as paint, whereby to deter the escape of liquids therefrom and enhance safe transportation thereof.

The above and further objects, features and advantages of this invention will be recognized by those of skill in the art from the following detailed description of a particular preferred embodiment thereof demonstrative of its features and illustrated in the accompanying drawings.

IN THE DRAWINGS

DESCRIPTION OF THE PREFERRED EMBODIMENT

Figure 1:
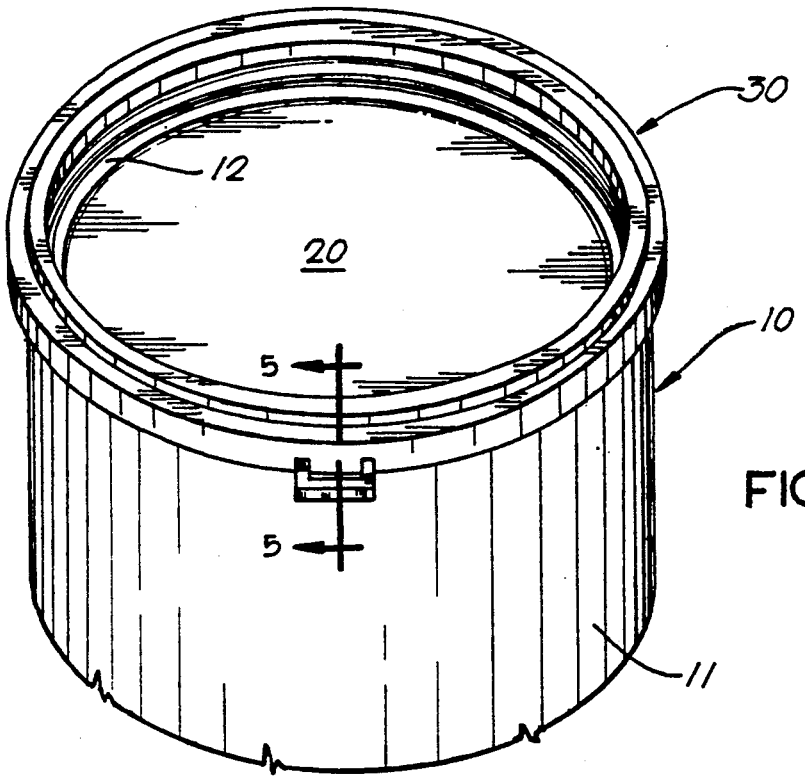
FIG. 1 is a perspective view from above of a typical covered metal paint can fitted with the transportation ring of this invention.
Figure 2:
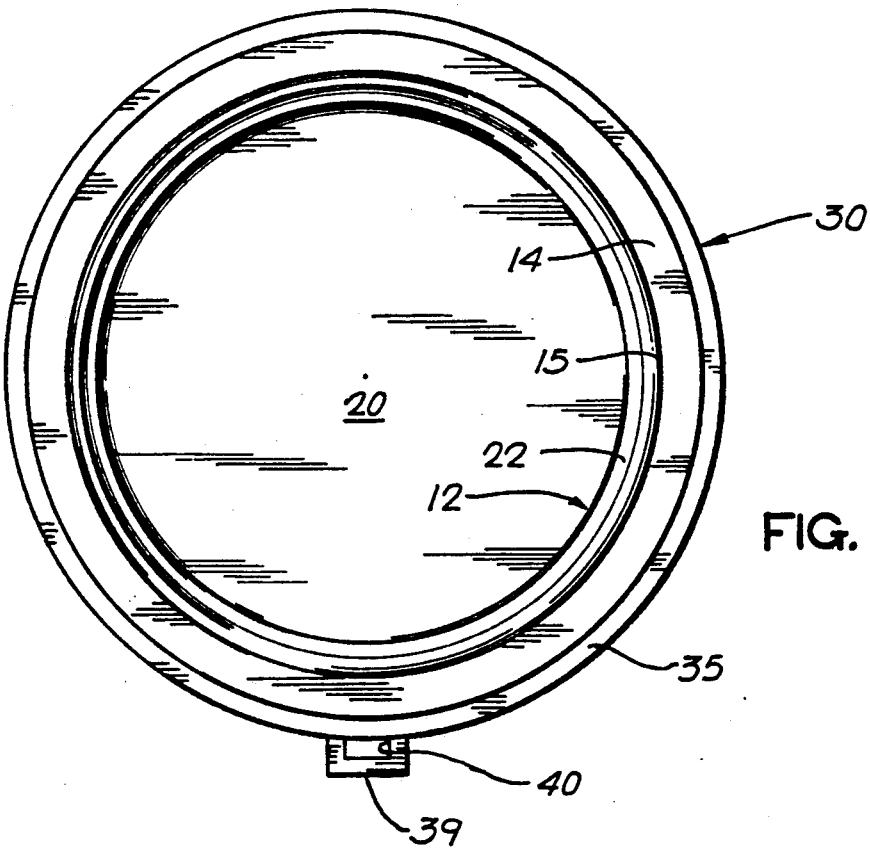
FIG. 2 is a top plan view of the paint can and ring assembly shown in FIG. 1.
Figure 3:
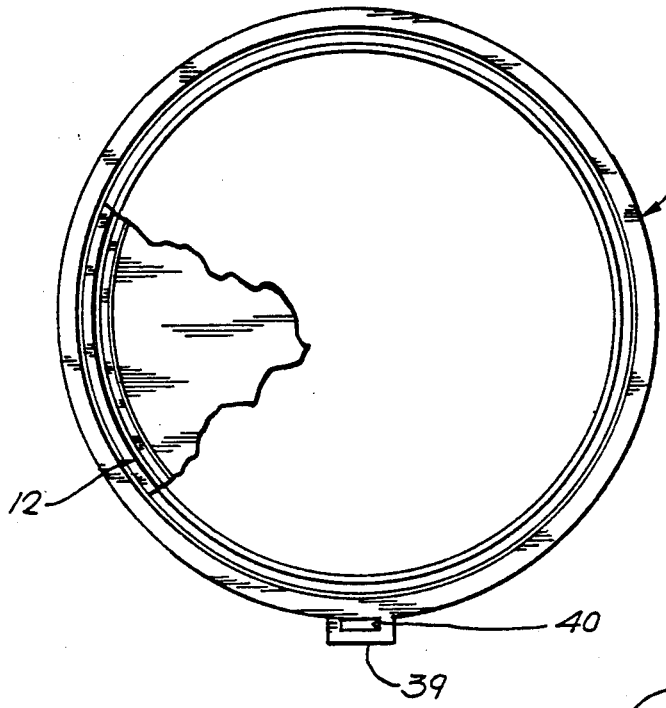
FIG. 3 is a bottom plan view of the assembled can and transportation ring illustrated in FIG. 1 with portions thereof broken away.
Figure 4:
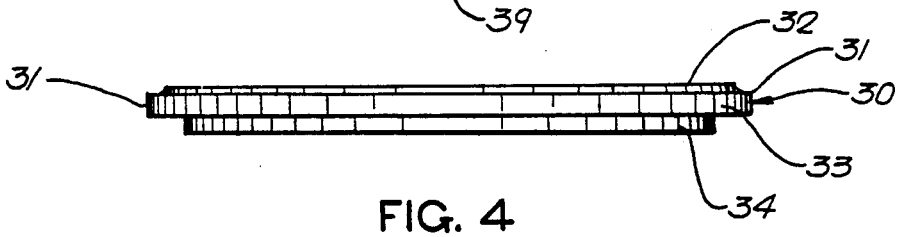
FIG. 4 is a side elevational view of the transportation ring shown in FIG. 1.

Turning now to the features of the preferred embodiment illustrated in the drawings, reference is made to drawing FIGS. 1–6 from which it will be recognized that the hereinafter described embodiment relates to a removable transportation ring for use with a cylindrical container having a friction-fit lid or cover for enclosing the open upper end of the container, such as the familiar one gallon paint can.

As shown best in FIG. 1 the can 10 is formed with cylindrical side walls 11 closed at the lower end thereof by a conventional transversely extending bottom wall (not shown). At the upper end of the container, side walls 11 are joined to an annular upper rim flange 12 (see FIGS. 5 and 6) by means of bead 13 formed by rolling the outer margin of the rim flange 12 with the top margin of the can's side walls 11 to form a fluid sealing rim bead in a known manner. Rim flange 12 includes a planar platform portion 14 which intervenes between bead 13 and a reentrantly formed U-shaped channel groove 15. The radially inner edge of the rim flange terminates in a annular scroll or folded bead 16 which defines a circular opening 17 in the top of the container 12 that is adapted to be sealed over by a removable cover or lid 20. It will be noted in particular that the beaded portion 16 of the rim flange preferably lies substantially opposite the beaded rim 13.

Figure 5:
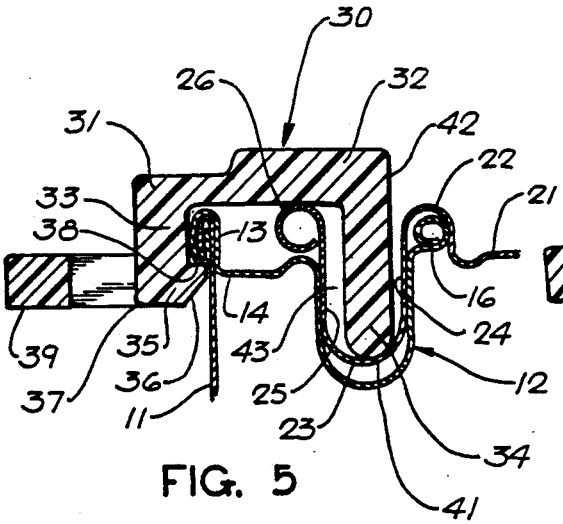
FIG. 5 is a partial enlarged cross sectional view taken substantially along vantage line 5—5 of FIG. 1 and looking in the direction of the arrows thereon.
Figure 6:
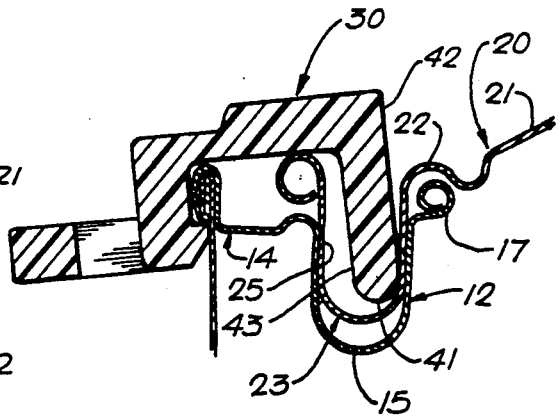
FIG. 6 is a cross sectional view corresponding to FIG. 5 and illustrating the operational position assumed by the transportation ring in the presence of internal can pressures or other forces tending to unseat the container cover.

Cover 20, in accordance with conventional practice, comprises a generally circular, disc-like member having a planar central portion 21 distinguished by an upwardly raised, semi-cylindrical annular rib portion 22 which fits over beaded portion 16 of the rim flange and defines the radial outer margin of the cover portion 21 per se. Portion 22 is integrally merged at its radially outer edge into an open top, U-shaped recess 23 of annular configuration having a radially inner wall 24 and a radially outer wall 25 disposed in substantially parallel spaced relationship and which reentrantly merge at their lower ends. The outer upper terminal edge of wall 25 is suitable rolled outwardly into a circular bead portion 26 aligned opposite rib portion 22. The spacing between the inner and outer walls 24 and 25 of the described cover configuration is such that the annular recess portion 23 of the cover is adapted to fit tightly within the underlying U-shaped channel 15 of the rim flange, as best shown in FIGS. 5 and 6. This effects a close fitting, frictional interlocking seal between the cover and container for purposes of sealing liquid contents within container 10, in a known manner. In the normal course of events a container, such as a one gallon paint can of the order illustrated, usually incorporates a handle or bail pivotal about trunion posts or the like extending outwardly of the side walls of the container (not shown herein) of familiar and known structure. Other bail or equivalent handle structures may be joined to ring 30, if desired. Typically a container, such as 10, is made of rolled and formed sheet metal, such as coated or corrosion resistant steel.

Turning now to the features of the improved transportation ring 30 of this invention, attention is initially directed to FIG. 1 of the drawings to illustrate the fact that the transportation ring is operationally mounted over the outer radial margin of the cover 20 and rim flange 12 of the container 10 for purposes of retaining the cover in its frictionally sealed engagement with the container to prevent escape of its contents. In particular ring 30 is specifically constructed not only to retain the cover 20 on the container in the presence of abnormal internal pressures within the container, but also to withstand external forces or blows against the top of the container or extreme differences between interior and exterior container pressures, which might destroy or disrupt the sealed integrity between container and cover or damage ring 30.

As best shown in FIGS. 1–4 of the drawings, the transportation ring 30 of this invention comprises a generally rigid, slightly resilient, unitary annular member or ring, preferably constructed by molding high density polyethylene or similar plastic material having high tensile impact resistance.

In greater particular it will be noted that ring 30 comprises a generally annular planar body portion 31 (see FIGS. 4–6) formed on its upper side with a raised planar platform portion 32 which is adapted to act as a stacking ring for guiding and receiving the bottom end of an over disposed container when vertically stacking a series of such containers. The underside of the ring body 31 is distinguished by a pair of parallel spaced downwardly extending limbs 33 and 34, integral with and depending at right angles to body portion 31, at the outer and inner radial margins thereof, respectively.

It best will be understood from FIGS. 5 and 6 that the outer limb 33 is of axial length or extension from body portion 31 substantially one half that of the inner limb 34 for reasons which will appear presently.

The outer radial limb 33 of ring 30 is characterized by a radially inwardly extending locking finger 35 adjacent its outer or operationally lower edge and which is of uninterrupted annular configuration. Finger 35 is distinguished by a chamfered surface 36 extending upwardly from its lower edge 37 to cam finger 35 past the beaded rim 13 of the container during the ring mounting operation. So mounted a second annular surface 38 of the finger 35, which extends at right angles to the lengthwise axis of limb 33 and therefore parallels body portion 31 of the ring, snaps beneath rim bead 13 and securely locks ring 30 in position over the outer top margin of the closed container as shown in FIG. 5.

Limb 33 also is provided, at one point along its circumference, with a generally rectangular shaped tab 39 which projects radially outwardly of limb 33 and has a central opening 40 receptive of the blade of a screwdriver or a like prying instrument. This permits removal of the mounted transportation ring from the container by placing the screwdriver blade in opening 40 and prying the ring upwardly to disengage the locking finger surface 38 from beneath rim bead 13.

As noted heretofore, the radial inner limb 34 of the transportation ring parallels the outer limb 33 and depends or extends downwardly from the body portion 31 of the ring a distance substantially twice that of the outer limb. The outer end 41 of limb 34 is suitably radiused in a semi-circular configuration as indicated in cross sectional FIGS. 5 and 6 and notably such limb is constructed with a wall thickness, i.e., radial width, somewhat narrower than the outer limb 33 and considerably narrower than the cover or lid recess 23 into which it extends when ring 30 is in its mounted position.

Specifically, it will be noted that the faces 42 and 43 of the limb 34 normally are spaced freely away from the walls 24 and 25, respectively, of recess 23 when ring 30 is in its mounted position (See FIG. 5) whereas the bottom end 41 thereof engages or nearly approaches the bottom reentrant end of recess 23. This relationship between limb 34 of the transportation ring and recess 23 of the container's lid or cover is of significant importance to the sealing and ring retaining operation of the transportation ring hereof as will be explained presently.

OPERATION

As best illustrated in FIG. 6, when container 10 is subjected to internal pressures or impact forces normally sufficient to disrupt the seal between the cover and the container's rim flange or, in severe cases, detach the cover from the container, the transportation ring of this invention operates to avoid leakage and retain the cover in place.

In the above described circumstances, excessive container pressure or disrupting impact can cause the cover wall 21 to bulge or bow upwardly, as shown in FIG. 6. Such happenstance tends to force the cover's sealing recess 23 away from or out of the rim flange channel 15, as shown, and in most cases moves the cover bead rib 22 away from the underlying bead 16 of the rim flange, breaking the usual seal therebetween. Leakage or loss of the cover generally would follow if it were not for the normal sealing contact between wall 25 of recess 23 and the adjacent wall of rim channel 15 plus the ring restraining and seal promoting operations of the transportation ring hereof.

As set out in FIG. 6, when the cover wall 21 bows upwardly, the rigid ring 30, upsets or distorts axially to in effect pivot about locking finger 35 and its line of gripping engagement with the underside of rim bead 13. This causes the lower portions of the ring's longer limb 34 to move radially inwardly and slightly upwardly in the cover recess 23 to press the outer end 41 and lower portions of wall 42 thereof, tightly against the adjacent wall 24 of the cover recess. Such action produces increasing radial force against wall 24 as upward movement of the cover progresses increasing engagement force between limb 34 and wall 24 and pressing the latter tightly against the adjacent wall of the rim flange channel 15 to promote and increase sealing engagement therebetween. At the same time, this distortion movement of ring 30, increases the gripping engagement of the ring's annular locking finger 35 beneath rim bead 13 to enhance the cover retaining function of ring 30. In this latter respect it is to be noted that removal of the ring by outward bowing of the cover top wall 21 requires either disruption or extreme deformation of the generally rigid unitary transportation ring or sufficient pressure within the container to blow or pop the cover off the container along with ring 30.

In testing the ring 30 of this invention according to the United Nations Packaging Tests for the Transport of Dangerous Goods, paragraph 9.7.5, Group II Test Level, the following procedures were employed.

The materials tested were four (4) one gallon paint cans with friction fit covers, each equipped with a transportation ring according to this invention.

EQUIPMENT USED

1. USG Pressure Gauge, 0–30 psi range
2. Watts Ball Valve and high pressure hose
3. Manual One Gallon Paint Can Lid Closing Tool
4. Source of pressurized fluid
5. Pressure fittings

HYDRAULIC TEST

A hole was drilled in the side of each can and a pressure fitting attached over the hole. A high pressure hose, ball valve and pressure gauge were connected to the fitting and a source of pressurized water. Each can was then filled with water and the lid secured in place closing the lid by means of the manual closing tool.

A transportation ring of this invention was then secured around the cover using the manual closing tool. Water at a constant pressure of 100 Kpa (14.5 psi) was then transmitted to the can's interior for a period of five (5) minutes to detect any leakage, as indicated by the pressure gauge.

After completion of the five minute leakage test water pressure was gradually increased to determine maximum hydraulic pressure at failure as indicated below.

TEST RESULTS

| Sample No. | Test Results |
|---|---|
| 1 | No Leakage Occurred - Satisfactory |
| 2 | No Leakage Occurred - Satisfactory Maximum Pressure - 17 psi, Ring popped off the can. |
| 3 | No Leakage Occurred - Satisfactory Maximum Pressure - 26 psi, Ring popped off the can. |
| 4 | No Leakage Occurred - Satisfactory Maximum Pressure - 21.5 psi, Ring popped off the can. |

As demonstrated by the above test results, it is clear that the ring hereof is retained in operating position and renders the usual one gallon paint can with friction fit lid capable of withstanding internal pressures without leaking or loss of the ring or cover, well beyond the requirements of the United Nations test requirements, as outlined above, to accomplish those objectives of this invention. In this regard a normal one gallon paint can with friction fit lid, without a transportation ring as taught herein fails by leaking or loss of its cover at 10 psi or less.

From the foregoing it is believed that those familiar with the art will recognize the novel advancement of this invention and will readily understand that while the same has been herein described in association with a particular preferred embodiment, illustrated in the accompanying drawings, the same is susceptible to variations, modification and substitution of equivalents without departing from the spirit and scope of this invention which is intended to be unlimited by the foregoing except as appears in the following appended claims.

The embodiments of the invention in which an exclusive property or privilege is claimed are defined as follows:

1. In combination a cylindrical container having an annular peripheral rim flange formed to define a generally U-shaped, annular locking channel about the container's open upper end, a disc-like lid for closing said container's open upper end formed with a marginal, U-shaped, annular recess having spaced walls adapted to frictionally fit into said channel to effect sealing engagement with opposing walls thereof, and a removeable transportation ring constructed to be mounted over the rim flange and outer margin of the mounted container lid to secure and retain the latter in sealed relation with the container, said ring comprising:

an uninterrupted, substantially rigid, unitary, annular ring of generally inverted U-shaped cross section formed with a generally planar annular body and a pair of parallel, continuous, uninterrupted, annular limbs depending from the outer and inner radial margins of said body;

the radially outer of said limbs having a radially inwardly extending, uninterrupted, single annular locking finger adjacent its outer end which is operable, when said ring is mounted on the container, to underengage the outer periphery of the container's rim flange and lock said ring thereto;

the radially inner of said limbs being dimensioned and disposed to depend freely into the lid's recess without engaging the walls thereof when said ring is mounted on the sealed container;

the container mounted ring, in the presence of pressures within the sealed container sufficient to bow and deflect the lid outwardly, being operable to distort axially upwardly without disruption, which activity causes the inner of said limbs to move radially against one wall of the lid's recess and thereby increase the latter's sealing engagement with an opposing wall of the container's locking channel; such activity also simultaneously causing said locking finger to increase its locking engagement with the container's rim flange.

2. The combination of claim 1, and an annular raised platform on the upper side of said body operable to guide and receive the bottom end of an over disposed container when stacking such containers vertically.

3. The combination of claim 1, and a rigid tab extending radially outwardly of the outer of said limbs, said tab having a central opening receptive of the outer end of a pry bar tool for removing said ring from said container.

4. The combination of claim 1, wherein said ring is an integral member of generally rigid, resilient high impact plastic.

5. The combination of claim 1, in which said locking finger is distinguished by an upwardly inclined guide surface at its lower end, and a radially extending locking surface, paralleling said body; said guide surface operating to guide said locking surface beneath the container's rim flange when attaching said ring to the upper end of the container.

6. The combination of claim 1, wherein the configuration and organization of said body, locking finger and limbs, cooperate with the rim flange and outer margin of the lid to effect and maintain multiple areas of liquid sealing engagement therebetween.

7. The combination of claim 1, wherein said ring is operable to maintain interlocked engagement with the container's rim flange and prevent disruption of the sealed integrity of the container and its lid in the presence of internal container pressures up to 26 psi for sustained periods of 5 or more minutes.

* * * * *